US007159281B1

(12) United States Patent
Irizarry

(10) Patent No.: US 7,159,281 B1
(45) Date of Patent: Jan. 9, 2007

(54) BELT CLIP ACCESSORY

(76) Inventor: Jose M. Irizarry, 175 Broadway, Apartment A1, Passaic, NJ (US) 07055

( * ) Notice: Subject to any disclaimer, the term of this patent is extended or adjusted under 35 U.S.C. 154(b) by 16 days.

(21) Appl. No.: 11/088,409

(22) Filed: Mar. 25, 2005

(51) Int. Cl.
*A41F 9/00* (2006.01)
*A45C 1/04* (2006.01)

(52) U.S. Cl. ..... 24/3.12; 24/3.11; 24/343; 248/113; 224/247; 224/933

(58) Field of Classification Search ..... 24/3.12, 24/3.11, 327, 329, 331, 332, 334, 338, 343; 248/110, 113, 316.5, 312; 224/904, 240, 224/247, 269, 270, 993, 667, 669, 933; 211/69.9, 211/69.8
See application file for complete search history.

(56) References Cited

U.S. PATENT DOCUMENTS 338,248 A * 3/1886 Capron ..... 248/113
781,629 A 2/1905 Ahlstrom
969,524 A * 9/1910 Condon ..... 224/247
999,658 A * 8/1911 Knieriemen ..... 248/113
1,246,492 A * 11/1917 Thiele ..... 248/113
1,495,925 A * 5/1924 Quertermous ..... 224/247
1,911,781 A * 5/1933 Wolfe, Jr. ..... 248/113
3,282,482 A * 11/1966 Scharsu ..... 224/247
4,358,036 A 11/1982 Maltais
5,248,072 A 9/1993 Jones
5,619,774 A 4/1997 Perry
5,946,733 A 9/1999 Spooner
D453,294 S 2/2002 Bitzer
6,688,505 B1 2/2004 Bradley et al.

* cited by examiner

*Primary Examiner*—Robert J. Sandy

(57) ABSTRACT

An accessory includes a belt that has a buckle. A clip is included that has upper and lower portions. The upper portion has an arcuate shape. The lower portion has a lip protruding therefrom for latching onto the belt. The clip includes a rectilinear arm that has a monolithically formed stop member. First and second jaw members are situated distal of the clip and include a flanged finger end portion. Each jaw member includes at least one flange member, provided with an axial bore, protruding inwardly towards the arm. A spring mechanism is included for articulating the jaw members between disengaged and engaged positions. A mechanism is included for swiveling the jaw members about an axis centrally registered with the arm. The swiveling mechanism cooperates with the spring mechanism so that the jaw members can rotate while being biased between the engaged and disengaged positions.

15 Claims, 3 Drawing Sheets

BELT CLIP ACCESSORY

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to belt clips and, more particularly, to a belt clip accessory for holding a pair of gloves about a user's waist.

2. Prior Art

It is known by common experience that work gloves are a necessary part of one's attire in careers such as construction, law enforcement, and certain professional sports, as they are necessary to protect the wearer against hand injuries. An unavoidable consequence is that the gloves are bulky and of a size which is not suitable for being carried in one's pockets, and thus, the storage of the work gloves when not being used is an inconvenience.

A prior art solution specifically concerned with work gloves shows a belt-attached canister bounding a compartment sized and shaped to the dimensions of the work gloves that is used for storage of the work gloves during their non-use. The canister's size and shape and outwardly protruding orientation from the user's belt are not desirable since it typically interferes with hand and arm movements of the wearer. This is very inconvenient, especially in cases, like construction work, where mobility is a high priority. Another example shows two U-shaped belt attachments wherein one lays his/her gloves within the U-shaped attachments. This specific example is impractical in the sense that when a user bends forward or backwards at a sufficient angle, the gloves may slip and fall from the U-shaped attachments. Obviously, it is preferable to have a means to fasten one's gloves to a belt where they are easily reached, yet securely held in place when not in use.

Accordingly, a need remains for a belt clip accessory in order to overcome the above-noted shortcomings. The present invention satisfies such a need by providing a belt clip accessory that is convenient and easy to use, safe to use, durable in design, and reasonable in price. Such a belt clip accessory secures gloves in place to prevent them from being lost or misplaced. Thus, the use of the belt clip saves users money which would otherwise be spent on replacing lost gloves. In addition, it saves one the time, energy and aggravation of searching for a lost glove or gloves. Such a belt clip accessory further eliminates the need to position one's gloves in their pant pockets, a very uncomfortable practice. Advantageously, the belt clip accessory is versatile in use, as it can be employed by a wide variety of people, such as construction workers, police men/women and baseball players.

BRIEF SUMMARY OF THE INVENTION

In view of the foregoing background, it is therefore an object of the present invention to provide a belt clip accessory. These and other objects, features, and advantages of the invention are provided by a belt clip accessory for holding a pair of gloves about a user's waist.

The accessory includes a flexible belt including a buckle for being conveniently adjustably positioned about a user's waist. A clip is included that has monolithically formed upper and lower portions. Such an upper portion has an arcuate shape. The lower portion has a lip protruding orthogonal therefrom such that the lip latches onto a bottom edge of the belt during operating conditions.

The clip further includes a monolithically formed rectilinear arm extending orthogonally from the upper portion. Such an arm has a monolithically formed stop member distally situated from the clip and extending parallel to the lip. The stop member has a diameter greater than a diameter of the arm for effectively preventing the arm from retracting beyond a fixed position.

First and second coextensive jaw members are situated distal of the clip. Each of the first and second jaw members includes a distally flanged finger end portion that has an arcuate shape. Such finger end portions may flange outwardly and away from a longitudinal axis registered with the arm. The first and second jaw members are selectively adaptable between engaged and disengaged positions wherein the first and second jaw members are pivotal about a vertical axis registered orthogonal to the arm. Such first and second jaw members are formed from spring plastic and are spaced above the lip of the clip.

Each of the first and second jaw members further includes at least one monolithically formed flange member protruding inwardly towards the arm and having a longitudinal length extending parallel thereto. Such flange members are provided with an axial bore formed therein and extending downwardly along a vertical axis. A plurality of rectilinear pins are nested within the axial bores and protrude downwardly therefrom for assisting the first and second jaw members to pivot thereabout during operating conditions.

A spring mechanism is included for conveniently automatically articulating the first and second jaw members from a disengaged position to an engaged position. Such a spring mechanism is disposed closer to the clip than to the finger end portions such that the finger end portions can advantageously be adequately articulated during operating conditions.

The spring mechanism preferably includes a deformably resilient spring member that has opposed end portions conjoined to the first and second jaw members respectively and is medially intercalated therebetween such that the spring member defines an adjustable spatial relationship between the first and second jaw members. Such a spring member has a centrally registered longitudinal axis disposed orthogonal to the axial bores such that the spring member is linearly compressed when the first and second jaw members are articulated along an arcuate path. The first and second jaw members are preferably at a closed position when the spring member is at equilibrium. The spring member is compressed when the first and second jaw members are selectively pivoted to the disengaged position.

The present invention further includes a mechanism for swiveling the first and second jaw members about an axis centrally registered with the arm. Such a swiveling mechanism cooperates with the spring mechanism in such a manner that the first and second jaw members can be rotated while being biased between the engaged and disengaged positions.

The swiveling mechanism preferably includes a plate disposed subjacent to the flange members and receiving the arm therethrough wherein the stop member of the arm prevents the arm from proximally moving beyond a predetermined and fixed position. The first and second jaw members are provided with proximal end portions adequately spaced apart for allowing the arm to linearly pass therebetween and define a maximum pivot angle along which the proximal end portions can be articulated during operating conditions.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
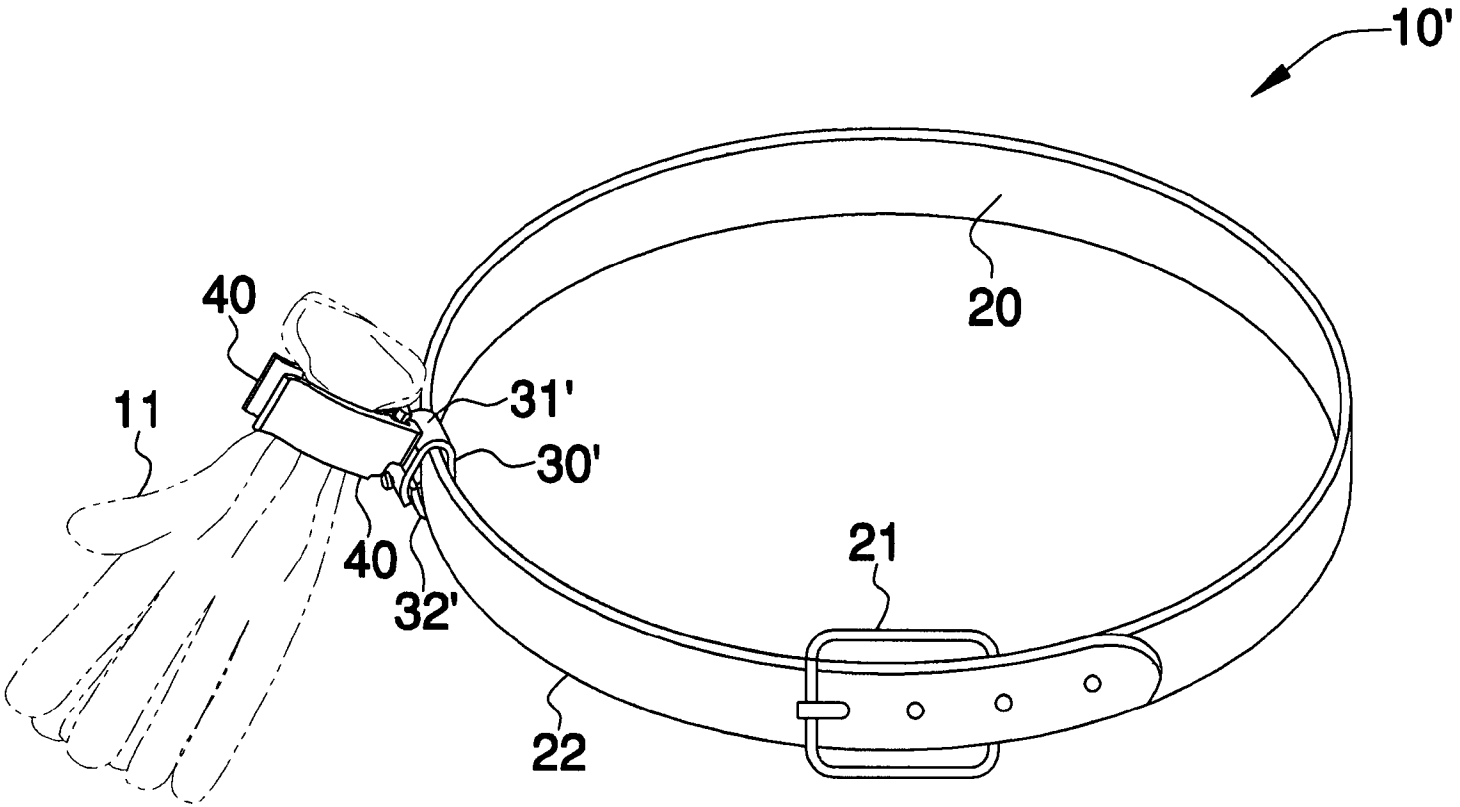
FIG. 1 is a perspective view showing a belt clip accessory, in accordance with the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this application will be thorough and complete, and will fully convey the true scope of the invention to those skilled in the art. Like numbers refer to like elements throughout the figures and prime numbers refer to alternate embodiments of such elements.

The apparatus of this invention is referred to generally in FIGS. 1–5 by the reference numeral 10 and is intended to provide a belt clip accessory. It should be understood that the apparatus 10 may be used to hold and secure many different types of items and should not be limited in use to only holding gloves.

Referring initially to FIG. 1, the apparatus 10 includes a flexible belt 20 including a buckle 21 for being conveniently adjustably positioned about a user's waist. Of course, belts 20 and buckles 21 of various shapes, sizes, colors and designs may be employed by the apparatus 10, as is obvious to a person of ordinary skill in the art. A clip 30 is included that has monolithically formed upper 31 and lower 32 portions. Such an upper portion 31 has an arcuate shape. The lower portion 32 has a lip 33 protruding orthogonal therefrom such that the lip 33 latches onto a bottom edge 22 of the belt 20 during operating conditions. This advantageously secures the apparatus 10 about a user's waist where the item 11 held therein are easily reached. In an alternate embodiment 10', the clip 30' is formed from flexible material and the upper 31' and lower 32' portions are detachably snapped to each other for securely fastening the clip 30' about the belt 20 so that the clip 30' can be slidably positioned along a length of the belt 20.

Figure 3:
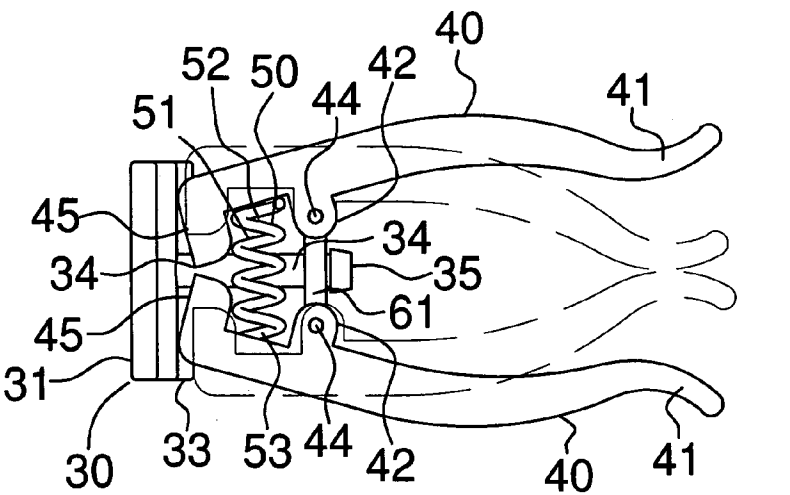
FIG. 3 is a top plan view of the apparatus shown in FIG. 2.
Figure 4:
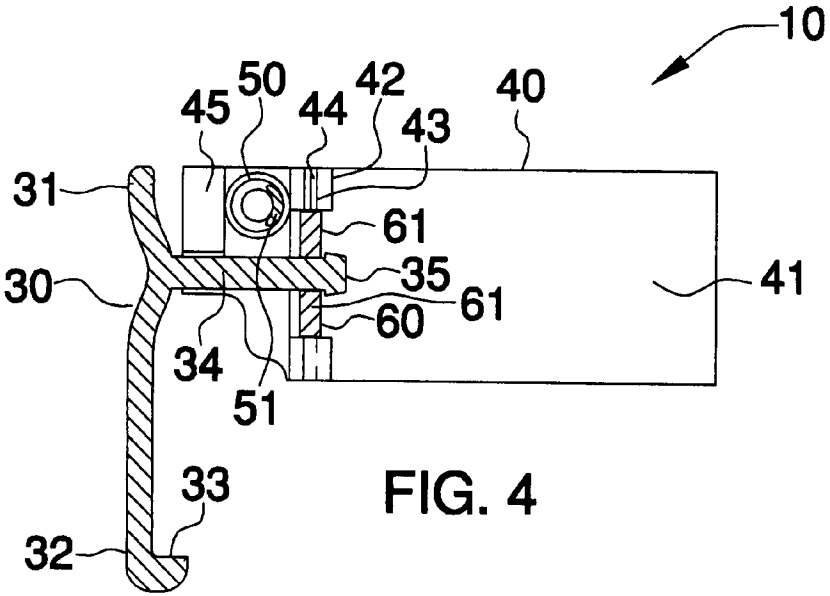
FIG. 4 is a cross-sectional view of the apparatus shown in FIG. 2, taken along line 4—4.

Referring to FIGS. 3 and 4, the clip 30 further includes a monolithically formed rectilinear arm 34 extending orthogonally from the upper portion 31. Such an arm 34 has a monolithically formed stop member 35 distally situated from the clip 30 and extending parallel to the lip 33. The stop member 35 has a diameter greater than a diameter of the arm 34, which is essential for effectively preventing the arm 34 from retracting beyond a fixed position.

Referring to FIGS. 1 through 5, first and second coextensive jaw members 40 are situated distal of the clip 30. Each of the first and second jaw members 40 includes a distally flanged finger end portion 41 that has an arcuate shape. Such finger end portions 41 flange outwardly and away from a longitudinal axis registered with the arm 24. The outwardly facing end portions 41 advantageously allows for an item to be positioned between the jaw members 40, such as a pair of gloves, without having to articulate the jaw members 40 to a disengaged position. The first and second jaw members 40 are selectively adaptable between engaged and disengaged positions wherein the first and second jaw members 40 are pivotal about a vertical axis registered orthogonal to the arm 34. Such first and second jaw members 40 are formed from spring plastic and are spaced above the lip 33 of the clip 30.

Figure 2:
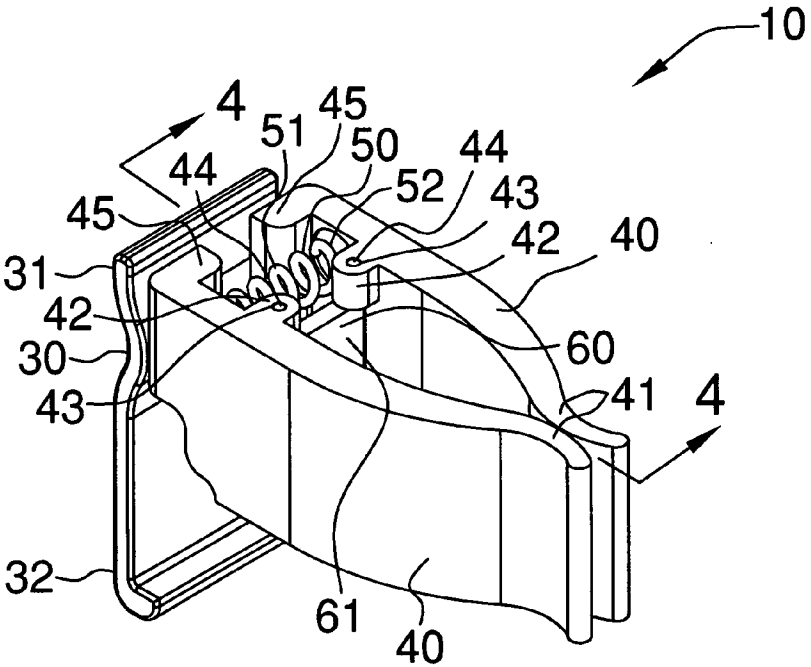
FIG. 2 is an enlarged perspective view of the apparatus shown in FIG. 1.
Figure 5:
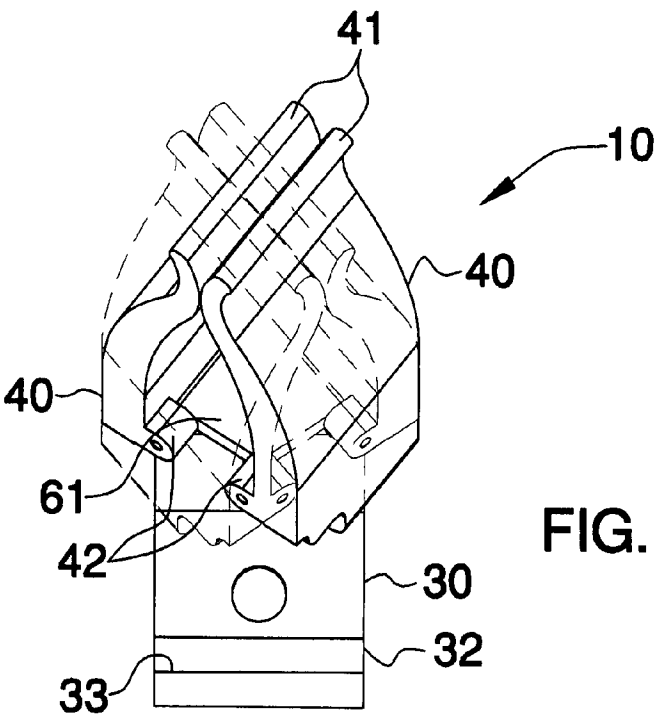
FIG. 5 is a front-elevational view of the apparatus shown in FIG. 2.

Referring to FIGS. 2 through 4, each of the first and second jaw members 40 further includes at least one monolithically formed flange member 42 protruding inwardly towards the arm 34 and has a longitudinal length extending parallel thereto. Such flange members 42 are provided with an axial bore 43 formed therein and extending downwardly along a vertical axis. A plurality of rectilinear pins 44 are nested within the axial bores 43 and protrude downwardly therefrom for assisting the first and second jaw members 40 to pivot thereabout during operating conditions.

Still referring to FIGS. 2 through 4, a spring mechanism 50 is included that is critical for conveniently and automatically articulating the first and second jaw members 40 from a disengaged position to an engaged position, allowing an item 11 to effectively be grasped between the jaw members 40. Such a spring mechanism 50 is disposed closer to the clip 30 than to the finger end portions 41 such that the finger end portions 41 can advantageously be adequately articulated during operating conditions.

Again referring to FIGS. 2 through 4, the spring mechanism 50 includes a deformably resilient spring member 51 that has opposed end portions 52 conjoined to the first and second jaw members 40 respectively and is medially intercalated therebetween such that the spring member 51 defines an adjustable spatial relationship between the first and second jaw members 40. Such a spring member 51 has a centrally registered longitudinal axis disposed orthogonal to the axial bores 43 such that the spring member 51 is linearly compressed when the first and second jaw members 40 are articulated along an arcuate path.

The first and second jaw members 40 are at a closed position when the spring member 51 is at equilibrium, which is essential for allowing the apparatus 10 to effectively secure an item 11 between the first and second jaw members 40. The spring member 51 is compressed when the first and second jaw members 40 are selectively pivoted to the disengaged position.

Referring to FIGS. 2 through 5, the present invention further includes a mechanism 60 for swiveling the first and second jaw members 40 about an axis centrally registered with the arm 34 for allowing a user to conveniently grasp and pull an item 11 from the jaw members 40 without fear of breaking the arm 34. Such a swiveling mechanism 60 cooperates with the spring mechanism 50 in such a manner that the first and second jaw members 40 can be rotated while being biased between the engaged and disengaged positions.

Still referring to FIGS. 2 through 5, the swiveling mechanism 60 includes a plate 61 disposed subjacent to the flange members 42 and receives the arm 34 therethrough wherein the stop member 35 of the arm 34 prevents the arm 34 from proximally moving beyond a predetermined and fixed position. This feature is critical and advantageous for ensuring that the first and second jaw members 40 do not separate from the clip 30. The first and second jaw members 40 are provided with proximal end portions 45 adequately spaced apart for allowing the arm 34 to linearly pass therebetween and define a maximum pivot angle along which the proximal end portions 45 can be articulated during operating conditions.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

The invention claimed is:

1. A belt clip accessory for holding a pair of gloves about a user's waist, said accessory comprising:

a flexible belt including a buckle for being adjustably positioned about a user's waist;

a clip having monolithically formed upper and lower portions, said upper portion having an arcuate shape, said lower portion having a lip protruding orthogonal therefrom such that said lip latches on to a bottom edge of said belt during operating conditions, said clip further including a monolithically formed rectilinear arm extending orthogonally from said upper portion, said arm having a monolithically formed stop member distally situated from said clip and extending parallel to said lip, said stop member having a diameter greater than a diameter of said arm for preventing said arm from retracting beyond a fixed position;

first and second coextensive jaw members situated distal of said clip, each said first and second jaw members including a distally flanged finger end portion having an arcuate shape, said first and second jaw members being selectively adaptable between engaged and disengaged positions wherein said first and second jaw members are pivotal about a vertical axis registered orthogonal to said arm, said first and second jaw members being formed from spring plastic;

wherein each said first and second jaw members includes at least one monolithically formed flange members protruding inwardly towards said arm and having a longitudinal length extending parallel thereto, said flange members being provided with an axial bore formed therein and extending downwardly along a vertical axis;

spring means for automatically articulating said first and second jaw members from a disengaged position to an engaged position; and means for swiveling said first and second jaw members about an axis centrally registered with said arm, said swiveling means cooperating with said spring means in such a manner that said first and second jaw members can be rotated while being biased between the engaged and disengaged positions.

2. The belt clip accessory of claim 1, wherein said spring means comprises:

a deformably resilient spring member having opposed end portions conjoined to said first and second jaw members respectively and being medially intercalated therebetween such that said spring member defines an adjustable spatial relationship between said first and second jaw members, said spring member having a centrally registered longitudinal axis disposed orthogonal to said axial bores such that said spring member is linearly compressed when said first and second jaw members are articulated along an arcuate path; and a plurality of rectilinear pins nested within said axial bores and protruding downwardly therefrom for assisting said first and second jaw members to pivot thereabout during operating conditions.

3. The belt clip accessory of claim 1, wherein said swiveling means comprises: a plate disposed subjacent said flange members and receiving said arm therethrough wherein said stop member of said arm prevents said arm from proximally moving beyond a predetermined and fixed position;

wherein said first and second jaw members are provided with proximal end portions adequately spaced apart for allowing said arm to linearly pass therebetween and define a maximum pivot angle along which said proximal end portions can be articulated during operating conditions.

4. The belt clip accessory of claim 2, wherein said first and second jaw members are at a closed position when said spring member is at equilibrium, said spring member being compressed when said first and second jaw members are selectively pivoted to the disengaged position.

5. The belt accessory of claim 1, wherein said finger end portions flange outwardly and away from a longitudinal axis registered with said arm.

6. A belt clip accessory for holding a pair of gloves about a user's waist, said accessory comprising:

a flexible belt including a buckle for being adjustably positioned about a user's waist;

a clip having monolithically formed upper and lower portions, said upper portion having an arcuate shape, said lower portion having a lip protruding orthogonal therefrom such that said lip latches on to a bottom edge of said belt during operating conditions, said clip further including a monolithically formed rectilinear arm extending orthogonally from said upper portion, said arm having a monolithically formed stop member distally situated from said clip and extending parallel to said lip, said stop member having a diameter greater than a diameter of said arm for preventing said arm from retracting beyond a fixed position;

first and second coextensive jaw members situated distal of said clip, each said first and second jaw members including a distally flanged finger end portion having an arcuate shape, said first and second jaw members being selectively adaptable between engaged and disengaged positions wherein said first and second jaw members are pivotal about a vertical axis registered orthogonal to said arm, said first and second jaw members being formed from spring plastic;

wherein each said first and second jaw members includes at least one monolithically formed flange members protruding inwardly towards said arm and having a longitudinal length extending parallel thereto, said flange members being provided with an axial bore formed therein and extending downwardly along a vertical axis;

wherein said first and second jaw members are spaced above said lip of said clip;

spring means for automatically articulating said first and second jaw members from a disengaged position to an engaged position; and means for swiveling said first and second jaw members about an axis centrally registered with said arm, said swiveling means cooperating with said spring means in such a manner that said first and second jaw members can be rotated while being biased between the engaged and disengaged positions.

7. The belt clip accessory of claim 6, wherein said spring means comprises:

a deformably resilient spring member having opposed end portions conjoined to said first and second jaw members respectively and being medially intercalated therebetween such that said spring member defines an adjustable spatial relationship between said first and second jaw members, said spring member having a centrally registered longitudinal axis disposed orthogonal to said axial bores such that said spring member is linearly compressed when said first and second jaw members are articulated along an arcuate path; and a plurality of rectilinear pins nested within said axial bores and protruding downwardly therefrom for assisting said first and second jaw members to pivot thereabout during operating conditions.

8. The belt clip accessory of claim 6, wherein said swiveling means comprises: a plate disposed subjacent said flange members and receiving said arm therethrough wherein said stop member of said arm prevents said arm from proximally moving beyond a predetermined and fixed position;

wherein said first and second jaw members are provided with proximal end portions adequately spaced apart for allowing said arm to linearly pass therebetween and define a maximum pivot angle along which said proximal end portions can be articulated during operating conditions.

9. The belt clip accessory of claim 7, wherein said first and second jaw members are at a closed position when said spring member is at equilibrium, said spring member being compressed when said first and second jaw members are selectively pivoted to the disengaged position.

10. The belt accessory of claim 6, wherein said finger end portions flange outwardly and away from a longitudinal axis registered with said arm.

11. A belt clip accessory for holding a pair of gloves about a user's waist, said accessory comprising:

a flexible belt including a buckle for being adjustably positioned about a user's waist;

a clip having monolithically formed upper and lower portions, said upper portion having an arcuate shape, said lower portion having a lip protruding orthogonal therefrom such that said lip latches on to a bottom edge of said belt during operating conditions, said clip further including a monolithically formed rectilinear arm extending orthogonally from said upper portion, said arm having a monolithically formed stop member distally situated from said clip and extending parallel to said lip, said stop member having a diameter greater than a diameter of said arm for preventing said arm from retracting beyond a fixed position;

first and second coextensive jaw members situated distal of said clip, each said first and second jaw members including a distally flanged finger end portion having an arcuate shape, said first and second jaw members being selectively adaptable between engaged and disengaged positions wherein said first and second jaw members are pivotal about a vertical axis registered orthogonal to said arm, said first and second jaw members being formed from spring plastic;

wherein each said first and second jaw members includes at least one monolithically formed flange members protruding inwardly towards said arm and having a longitudinal length extending parallel thereto, said flange members being provided with an axial bore formed therein and extending downwardly along a vertical axis;

wherein said first and second jaw members are spaced above said lip of said clip;

spring means for automatically articulating said first and second jaw members from a disengaged position to an engaged position;

wherein said spring means is disposed closer to said clip than to said finger end portions such that said finger end portions can be adequately articulated during operating conditions; and means for swiveling said first and second jaw members about an axis centrally registered with said arm, said swiveling means cooperating with said spring means in such a manner that said first and second jaw members can be rotated while being biased between the engaged and disengaged positions.

12. The belt clip accessory of claim 11, wherein said spring means comprises:

a deformably resilient spring member having opposed end portions conjoined to said first and second jaw members respectively and being medially intercalated therebetween such that said spring member defines an adjustable spatial relationship between said first and second jaw members, said spring member having a centrally registered longitudinal axis disposed orthogonal to said axial bores such that said spring member is linearly compressed when said first and second jaw members are articulated along an arcuate path; and a plurality of rectilinear pins nested within said axial bores and protruding downwardly therefrom for assisting said first and second jaw members to pivot thereabout during operating conditions.

13. The belt clip accessory of claim 11, wherein said swiveling means comprises: a plate disposed subjacent said flange members and receiving said arm therethrough wherein said stop member of said arm prevents said arm from proximally moving beyond a predetermined and fixed position;

wherein said first and second jaw members are provided with proximal end portions adequately spaced apart for allowing said arm to linearly pass therebetween and define a maximum pivot angle along which said proximal end portions can be articulated during operating conditions.

14. The belt clip accessory of claim 12, wherein said first and second jaw members are at a closed position when said spring member is at equilibrium, said spring member being compressed when said first and second jaw members are selectively pivoted to the disengaged position.

15. The belt accessory of claim 11, wherein said finger end portions flange outwardly and away from a longitudinal axis registered with said arm.

* * * * *